US007980520B2

(12) United States Patent
Taylor

(10) Patent No.: US 7,980,520 B2
(45) Date of Patent: Jul. 19, 2011

(54) HANGING APPARATUS ASSEMBLY AND METHOD

(76) Inventor: Scott Taylor, Arlington, WA (US)

( * ) Notice: Subject to any disclaimer, the term of this patent is extended or adjusted under 35 U.S.C. 154(b) by 429 days.

(21) Appl. No.: 12/050,741

(22) Filed: Mar. 18, 2008

(65) Prior Publication Data

US 2009/0065662 A1 Mar. 12, 2009

(51) Int. Cl.
*A45F 3/44* (2006.01)

(52) U.S. Cl. ..... 248/156; 248/345; 248/530; 248/159; 248/527

(58) Field of Classification Search ..... 248/156, 248/345, 511, 519, 523, 530, 159, 524, 527, 248/545
See application file for complete search history.

(56) References Cited

U.S. PATENT DOCUMENTS 2,597,157 A * 5/1952 Martino ..... 248/150
3,076,557 A * 2/1963 Husted et al. ..... 211/196
3,285,554 A * 11/1966 Voelkerding ..... 248/121
3,317,168 A * 5/1967 Ziph ..... 248/156
3,823,785 A * 7/1974 Toliver ..... 173/90
3,843,079 A * 10/1974 Reisling ..... 248/530
3,995,796 A * 12/1976 Kline ..... 248/121
4,096,951 A * 6/1978 Menssen ..... 211/207
5,082,231 A * 1/1992 Knowles ..... 248/545
5,108,058 A * 4/1992 White ..... 248/126
D359,437 S * 6/1995 Bilotti ..... D8/349
5,487,476 A * 1/1996 Barfield ..... 211/85.23
6,953,180 B1 * 10/2005 Ruvalcaba et al. ..... 248/530
7,172,163 B1 * 2/2007 Johnson ..... 248/146
7,469,865 B2 * 12/2008 Mayorga ..... 248/85

* cited by examiner

*Primary Examiner* — Anita M King
(74) *Attorney, Agent, or Firm* — Dwayne E. Rogge; Hughes Law Firm, PLLC

(57) ABSTRACT

A garden item hanger assembly. The assembly has an upright with a first and second portion. The first end of the first portion and the second end of the second portion can be connected together by using a medial connection portion which provides a flush surface. The assembly also has a ground engaging stake with a self centering socket and a plurality of set screws to set the upright. The ground engaging stake utilizes a plurality of moment resisting surfaces to maintain an upright position against both a first and second moment about the ground engaging stake applied by the item load.

21 Claims, 15 Drawing Sheets

HANGING APPARATUS ASSEMBLY AND METHOD

RELATED APPLICATIONS

This application claims priority benefit of co-pending U.S. patent application Ser. No. 10/387,638, filed Mar. 13, 2003 incorporated herein by reference.

DESCRIPTION OF THE PREFERRED EMBODIMENTS

Figure 1:
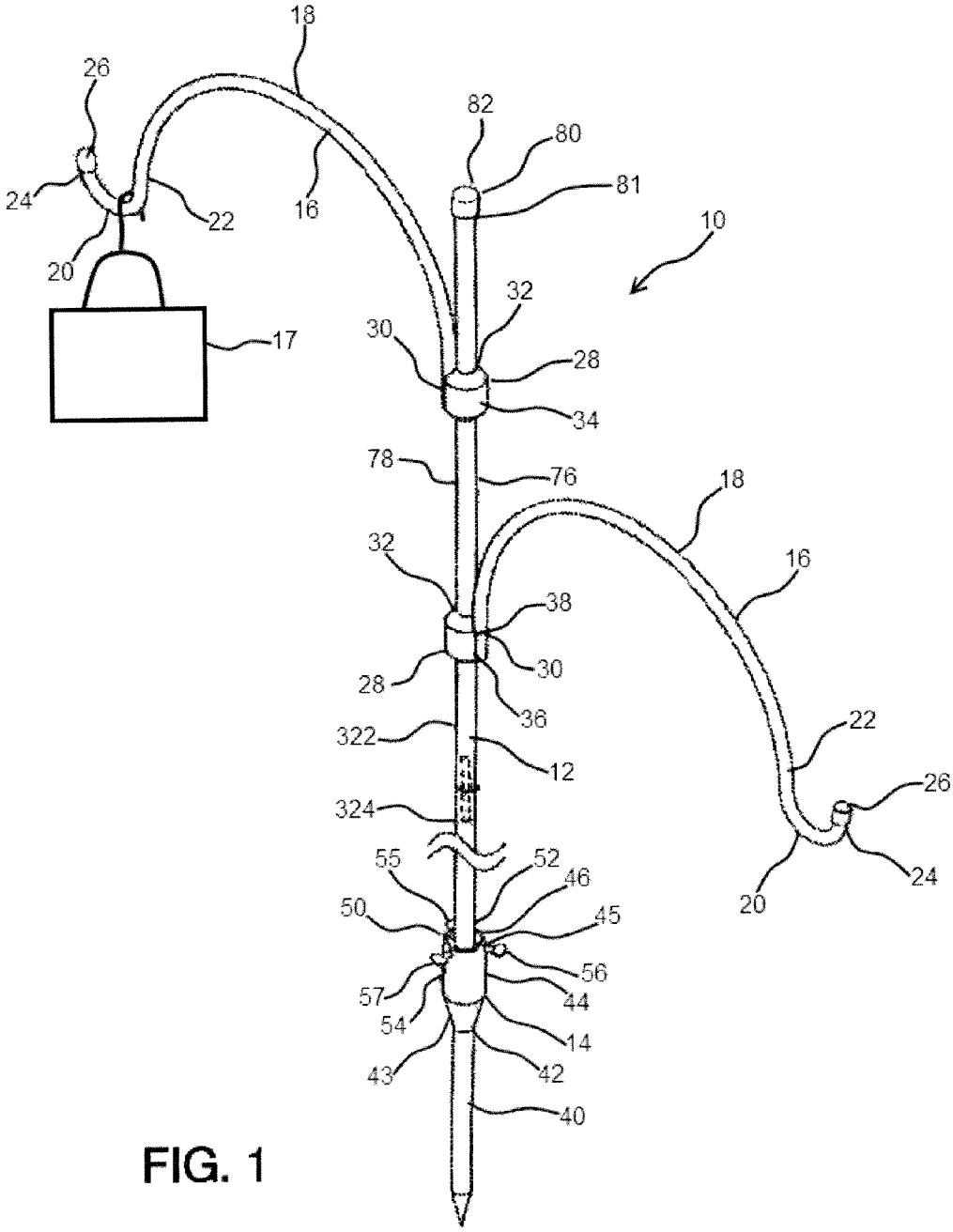
FIG. 1 is a perspective view of a first variation of an embodiment showing how the hanging apparatus can be inserted into the ground with a spiked stand portion.

Referring now to the drawings in general and in particular to FIG. 1, there is shown a perspective view of a first variation of the first preferred embodiment of the hanging apparatus. The hanging apparatus of the present concept is shown generally by the number 10.

The first preferred embodiment positions a pole or upright member 12 in a generally upright position, and two variations provide that the upright member 12 be inserted into a stand portion 14 whereby it is held upright from a floor or ground. In both variations of the first preferred embodiment, the hanging apparatus 10 includes the pole or upright member 12 and a plurality of hangers 16 that are removably attached to the upright member 12.

The hangers 16 are round and solid curved metal used to position an item 17 that would be hung on the hanger 16 away from the upright member 12 so that the upright member 12 would not be in the way of the item being hung. Each hanger 16, as used in all the preferred embodiments hereinafter described, is generally an inverted u-shaped hanger 18 having a smaller u-shaped hook 20 at the end 22 of the hanger 16 that is distal to the upright member 12.

The u-shaped hook 20 at the end 22 of the hanger 16 that is distal to the upright member 12 is adapted so that an item 17 being hung on this u-shaped hook 20 will not easily be blown off the hook 20 by wind or jostling. Each exposed end 24 on this u-shaped hook 20 is covered with a vinyl cap 26.

Each hanger 16 is removably attached to the upright member 12 by means of a generally donut-shaped attachment 28, the donut-shaped attachment 28 being fixedly attached to the hanger 16 at the end 30 of the hanger 16 that is proximal to the upright member 12, whereby the hole 32 of the donut-shaped attachment 28 would be positioned over the upright member 12 and held in place at the chosen position on the upright member 12 by a set screw 34 through the donut-shaped attachment 28. The donut-shaped attachments 28 have a groove 36 machined down one side 38 to align the hanger 16 in relation to the upright member 12.

In the first variation of the first preferred embodiment, as seen in FIG. 1, the stand portion 14 is provided as a stake anchor arrangement 11, and includes a spike portion 40 with a point for inserting the stand portion 14 into the ground. The spike portion 40 of the first variation of the first preferred embodiment is sized and shaped for an easy drive into the ground.

The length of the spike portion 40 is short enough so as not to hit underground utilities and also to provide a secure and stable stand. Fixedly attached at the top 42 of the spike portion 40, there is a generally tubular base 44 that holds a socket portion 46. At the top 45 of the generally tubular base 44, there is an opening 50 accommodated to receive the bottom 52 of the upright member 12, as seen in FIG. 1.

Figure 6:
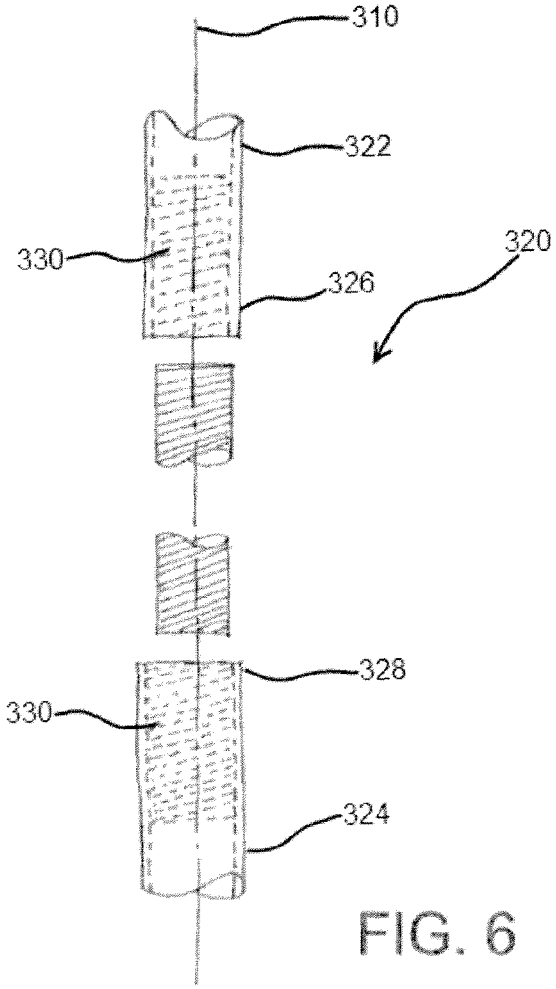
FIG. 6 is a detail elevation view of a first embodiment of the medial connection portion.

The upright member 12 itself is divided into an alternative embodiment a first upright portion 322 and a second upright portion 324. The upright member 12 is divided into at least two sub portions so that the hanging apparatus 10 can be easily shipped and reassembled. Referring briefly to FIG. 6, the first upright portion 322 has a first end 326. Second upright portion 324 has a second end 328.

The upright in this particular embodiment is a tubular construction and has an outer diameter in this present embodiment of approximately ⅞ of an inch. To connect the first upright portion 322 and the second upright portion 324 together, a medial connection portion 320 is utilized. This medial connection portion may be a cylindrical stud, a bolt, a screw, a bar, or other mechanism to accomplish a male to female connection.

In the present embodiment, the medial connection portion 320 is provided as a nonstandard diameter threaded cylindrical stud which is configured to mate with the first end 326 of first upright portion 322 and second end 328 of the second upright portion 324. Each of the upright portions has an inner threaded portion. In the first embodiment, the first upright portion 322 has an inner threaded portion 330 and the second upright portion 324 also has an inner threaded portion 330.

During manufacturing of the unit or hanging apparatus 10, the medial connection portion 320 may be securely attached to the first and or second end of the upright member 12 by utilizing a lock tight securing compound. The medial connection portion 320 in this particular embodiment is proximately 2 inches in length, and has an outer diameter of approximately 0.675 inches. In addition to utilizing a threaded bolt, a quick release tech mechanism may be utilized, a through pin connection may be utilized, or other type of medial connection portion.

As indicated above, the hanging apparatus 10 may be broken down or shipped in an unassembled condition. Referring to FIG. 3C, a garden item hanger assembly 380 is provided where the assembly is shipped in an assembly container 382.

Figure 4:
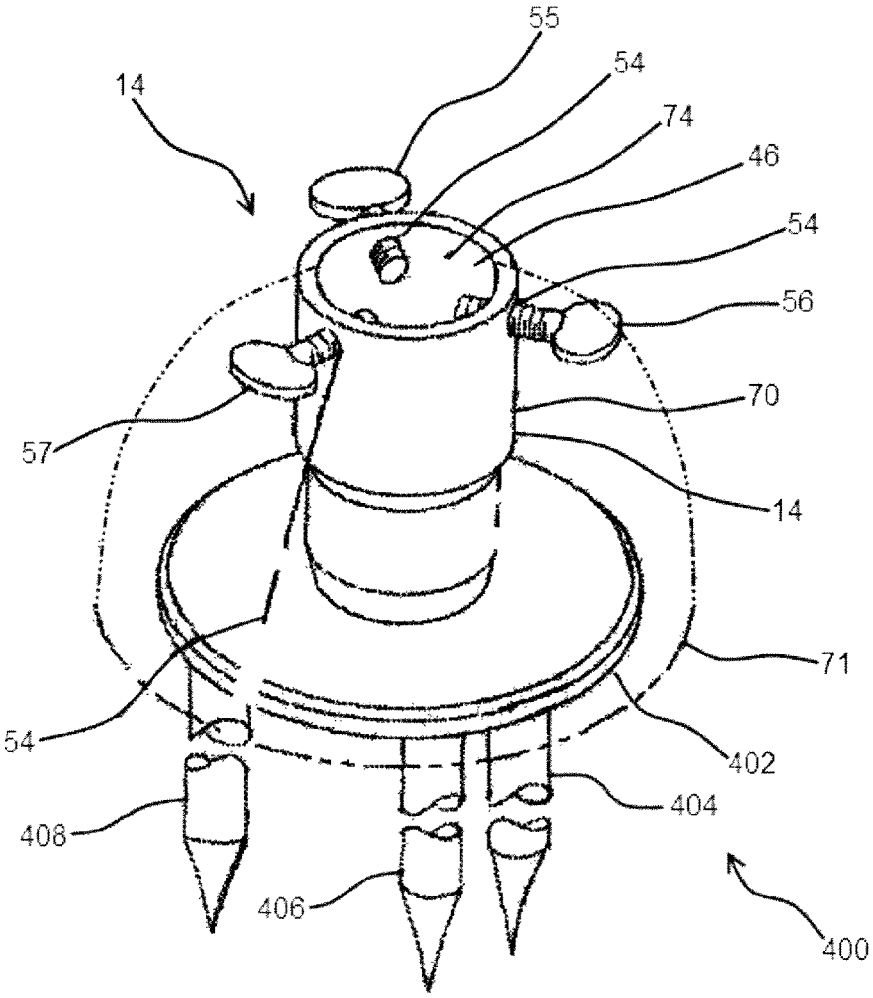
FIG. 4 is a perspective view of an alternative embodiment of the stake anchor encased with a cover.

The first upright portion 322, the second upright portion 324 are both laid longitudinally parallel to one another along with the anchor, or spike portion 14. The drive pipe 58 is included, as well as the medial connection portion 320. Also included in the assembly container is the hanger 16 and the cover 71 not shown in this particular embodiment, but as seen in FIG. 4.

A discussion of the anchor portion or stand portion 14 all now be further provided.

Figure 2:
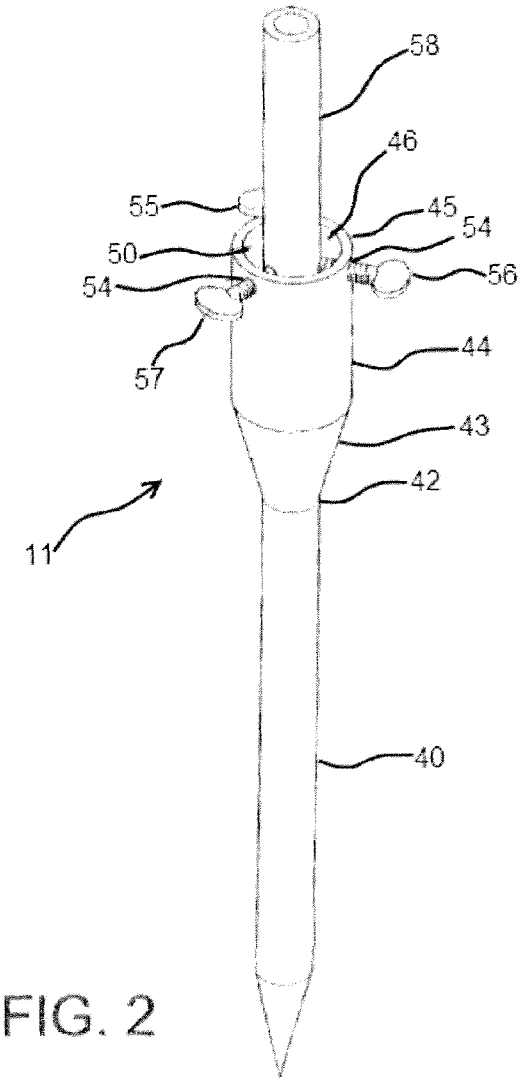
FIG. 2 is a perspective view of the spiked stand portion of a first embodiment as seen in FIG. 1.

The generally tubular base 44 further includes a plurality of holes 54 adapted to receive a plurality of set screws or thumb screws 55, 56, and 57, as seen most clearly in FIG. 2, that are used to position the upright member 12 in the desired position.

A shortened upright member or drive pipe 58 of the stake anchor 11, as seen in FIG. 2, is also included as part of the generally tubular base 44 of the first variation of the first preferred embodiment, so that the spike portion 40 of the base 44 can easily be pounded into the ground without having to pound on a tall and unwieldy upright member 12.

The drive pipe 58 is also used to take hammer force during installation so as not to damage the socket portion 46 of the base 44. To accept the drive pipe 58 as well as the upright member 12, the socket portion 46 has a larger inner diameter to receive the diameter of the drive pipe 58 or the upright member 12. To transition between the lower portion of the tubular base 44 and the spike portion 40, a conically tapered intermediate portion 43 transitions between the larger diameter tubular base 44 and the smaller diameter spike portion 40.

The socket portion 46 of the tubular base 44 has a conically shaped inner surface enabling the upright member 12 or the drive pipe 58 to self-centered during tightening of the set screws or thumbscrews 55, 56, and 57.

Figure 2A:
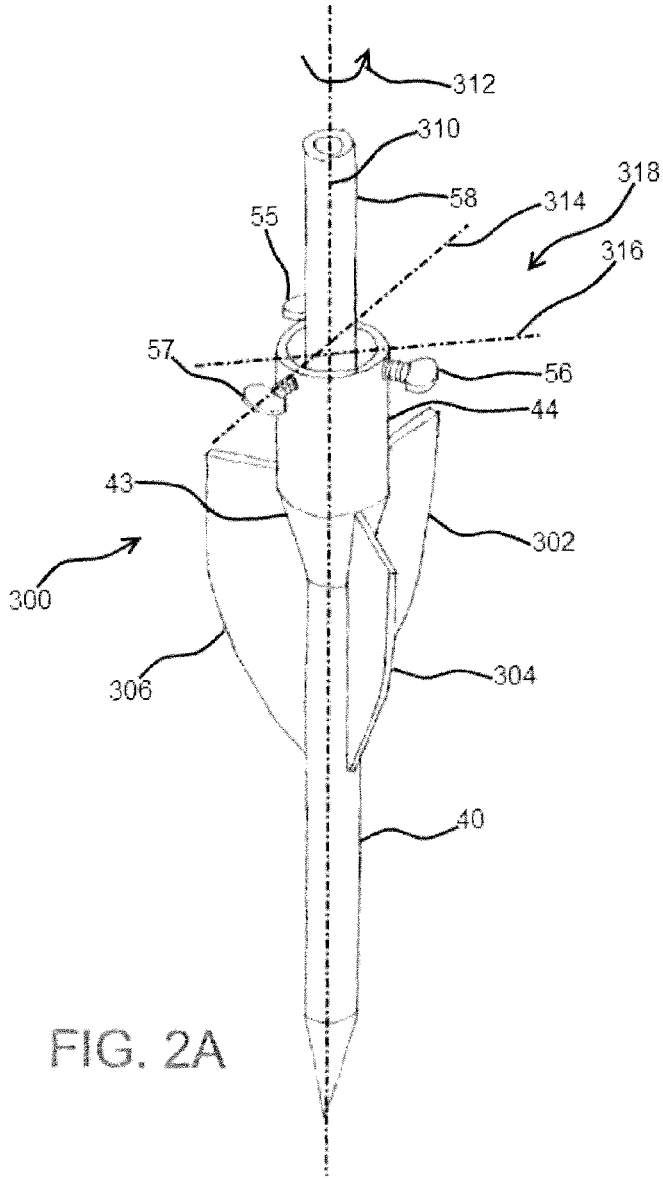
FIG. 2A is a perspective view of an alternative embodiment of the spiked stand portion.

In an alternative embodiment of the stake anchor 300, as seen in FIG. 2A, the stake anchor has a plurality of radialy aligned fins. They include a first radialy aligned fin 302, a second radialy aligned fin 304, and a third radialy aligned fin 306. The radialy aligned fins are spaced circumferentially equidistant about the stake anchor 300. In this particular embodiment, the fins provide additional ground engaging surface area to resist torque or moment of the pole or upright spinning about its vertical axis 310. The torque being applied from a second moment 312 about the vertical axis 310 originating from say for example a wind load applied to the item load supported on the hanger. A more complete discussion will be provided below.

In addition to the vertical axis 310, the stake anchor 300 is also arranged about a horizontal axis 316 and a transverse axis 314 which define a radial plain plane 318. The radialy aligned fins 302 through 306 extend from the bottom edge of the tubular base down into the top portion of the spike portion 40. The radialy aligned fins are configured to easily slice into the ground engaging location as can be seen in this particular embodiment by their tapered configuration.

Figure 3A:
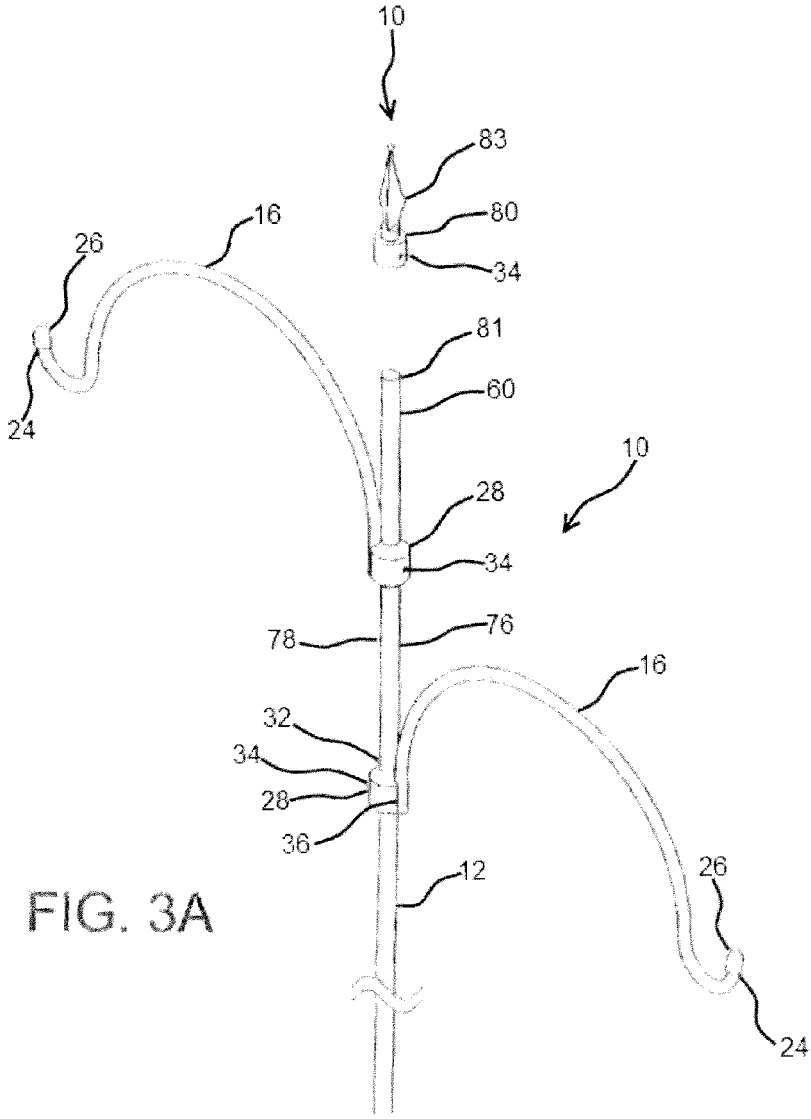
FIG. 3A is a perspective view of an alternative embodiment showing a decorative finial at the top of the hanging apparatus.
Figure 3B:
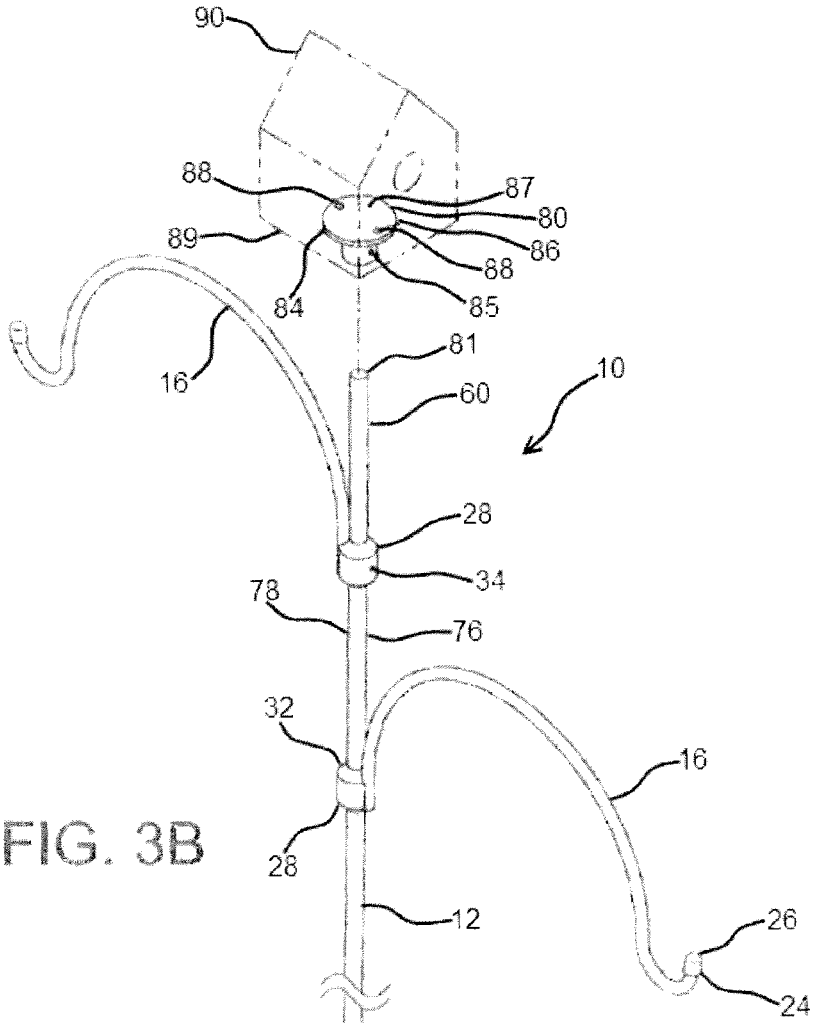
FIG. 3B is a perspective view of an alternative embodiment showing a functional adapter at the top of the hanging apparatus.
Figure 3C:
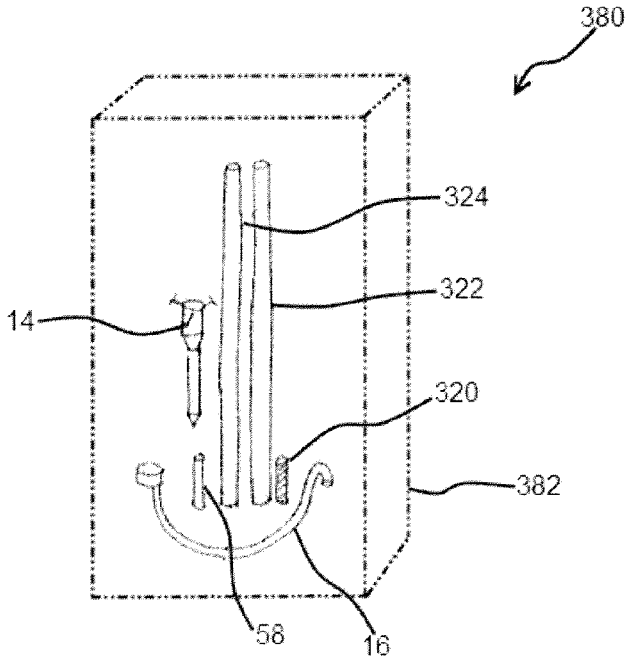
FIG. 3C is a perspective view of the assembly arranged in a shipping container.

In an alternative embodiment of the hanging apparatus 10, and referring to FIGS. 3A and 3B, the upper portion 60 of the hanging apparatus 10 is substantially the same as in the first variation of the first preferred embodiment. However in one alternative embodiment, a decorative finial 83 is attached to the upper end 80 which has a set screw 34 for attaching to the top 81 of the upper portion 60 of the upright 12.

The adapter 84 as shown in FIG. 3B, has a lower portion 85 which fits over the top 81 of the upright member 12. An upper portion 86 of the adapter 84 has a flat surface 87 with screw holes 88 therethrough for receiving screws that would secure the upper portion 86 of the adapter 84 to the bottom surface 89 of a birdhouse, bird feeder or the like 90, as seen in phantom in FIG. 3B. All upper end caps 80 in FIGS. 1, 3A and 3B are examples, and it is within the spirit and scope of the concept to use any type of ornamental and/or functional upper end cap 80.

Figure 4A:
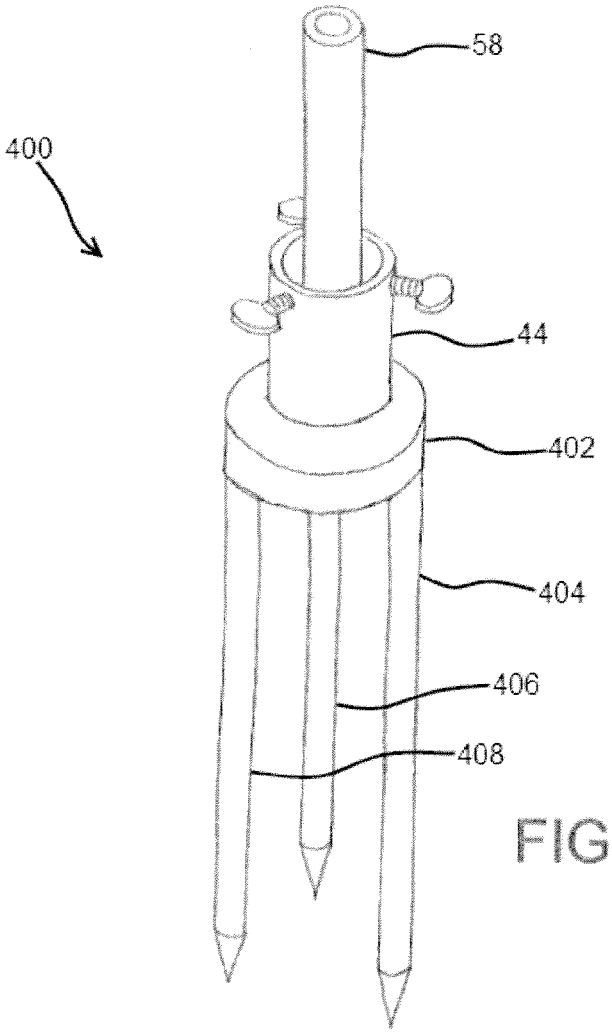
FIG. 4A is a perspective view of an alternative embodiment of the stake anchor.

Referring to FIGS. 4 and 4A, the stand portion 14 is shown in an alternative embodiment utilizing a triple spike stake anchor 400. The adjustment mechanism of the tubular base 44 is substantially the same as the first embodiment of the stake anchor 300. Attached to the bottom portion of the tubular base 44 is a spike plate 402 which enables a plurality of ground engaging spikes to be positioned circumferentially about the spike plate 402. In this particular embodiment, the spike plate 402 is circular, other geometric configurations of the spike plate for positioning the plurality of ground engaging spikes on the bottom portion of the spike plate 402 are readily conceived. For example, a rectilinear spike plate, a triangular spike plate, an oval spike plate, or any other two-dimensional or three-dimensional configuration could be utilized.

In this particular embodiment is seen in FIGS. 4 and 4A, the spike plate has three ground engaging spikes attached to its base plate portion, these spikes include a first spike 404, a second spike 406, and the third spike 408. These spikes are positioned equidistantly about the circumference of the spike plate 402 and when engaging the ground, provide moment resistance about the vertical axis 310 as previously discussed.

The stand portion 14 can be covered by any kind of decorative or functional cover 71, as shown in phantom in FIG. 4. Each stand portion 14, 300, or 400, accommodates a wide range of motion, whereby an upright member 12 can be driven into either stand portion 14 or 61 crookedly and then still be straightened up by means of the thumb screws 55, 56, and 57.

So the upright member 12 can be straightened after the spike portion 40 is driven into the ground as seen in FIGS. 3A, 3B, 4, and 5, the upright member 12 can be straightened after the upright member 12 is put into the stand portion 14.

The spike portion of the stand portion 14 can be driven into the ground at an angle, or the ground may be sloped, but the upright member 12 can still be plumb vertically, unless a particular controlled angle other than plumb is desired. If it is desirable to have the upright member 12 at a position other than ninety degrees relative to the ground, the stand portion 14 will allow the upright member 12 to be as much as eight degrees off true center of the stand portion 14.

So that if the upright member 12 can be as much as eight degrees off true center on either side 76 or 78 of the upright member 12 there is a total range of motion of sixteen degrees. Further, if one hanger 16 carries a heavy item on the first side 76 of the upright member 12, another hanger 16 can be positioned opposite to the first hanger 16, on the second side 78 of the upright member 12, to offset the weight of the first item, by placing an equally heavy item opposite to the first item.

More than two hangers 16 can be used on the upright member 12, and they may be spaced equally rotationally at zero degrees, one hundred twenty degrees and two hundred and forty degrees, for example, to offset weight at the various positions. In the first and second variations of the first preferred embodiment, there is also provided an upper end cap 80 at the top 81 of the upright member 12, and this can be of any decorative or practical nature.

In FIG. 1 the upper end cap 80 is shown in the form of a simple vinyl or plastic cap 82 similar to the vinyl caps 26 that cover the exposed end 24 on the hook 20 of the hanger 16. In FIG. 3A the upper end cap 80 is shown in the form of a decorative finial 83. In FIG. 3B the upper end cap 80 is shown in the form of a functional adapter 84.

Figure 5:
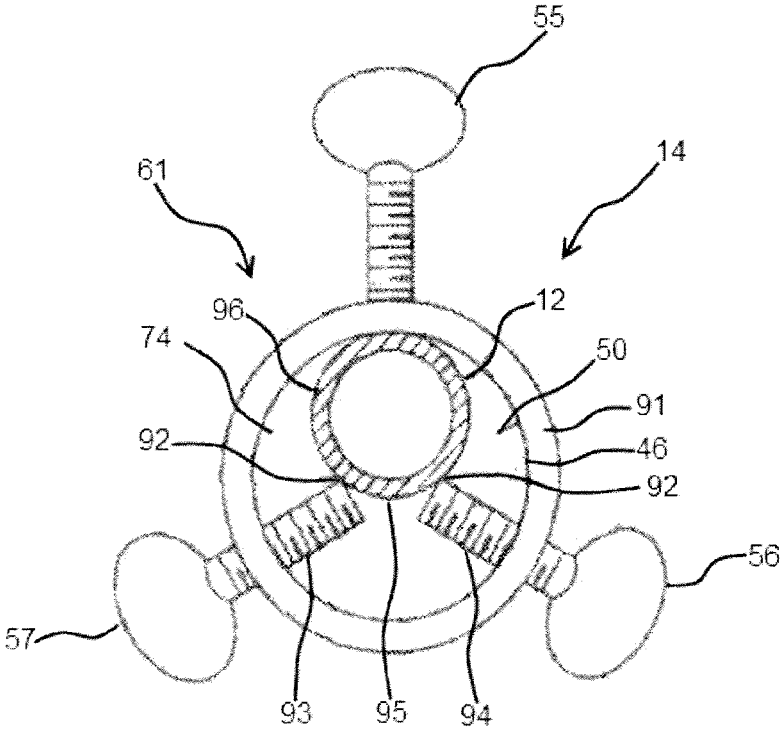
FIG. 5 is a top down view of the inside of a stand portion of the an embodiment.

Referring now to FIG. 5 of the drawings, there is shown a top down view of the inside of the stand portions of the first and second variations of the first preferred embodiment. Each stand portion 14, 300, 400 includes a socket portion 46. The socket portion 46 is within the generally tubular base 44 or within the top cylindrical section 70. The top 91 of the socket portion 46 includes the opening 50 or 74 that is accommodated to receive an upright member 12.

The socket portion 46 of the stand portions is coned on the inside in order to self-center an upright member 12, as seen in FIGS. 1, 3A and 3B. The thumb screws 55, 56, and 57 used in the socket portions 46 are located and sized to provide full contact with an upright member 12 at all times and in all positions. FIG. 5 details the ratio detail of the alignment of the thumb screws 55, 56, and 57 and the contact point 92 where the thumb screws 55, 56, and 57 contact the upright member 12.

Different sizes of socket portions 46, upright members 12, and thumb screws 55, 56, and 57 can be used as long as in the extreme adjustment position, the same alignment of sides 93 and 94 of the thumb screws 55, 56, and 57, and the projected intersecting point 95 on the outside surface 96 of the upright member 12 remains constant as that described with reference to FIG. 5.

Figure 7A:
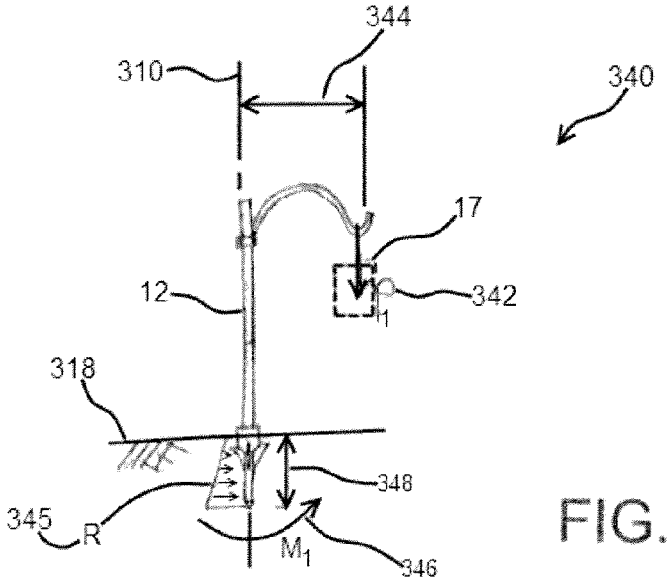
FIG. 7A is an elevation a view of the an embodiment resisting a vertical load from the item a moment arm distance away from the upright.
Figure 7B:
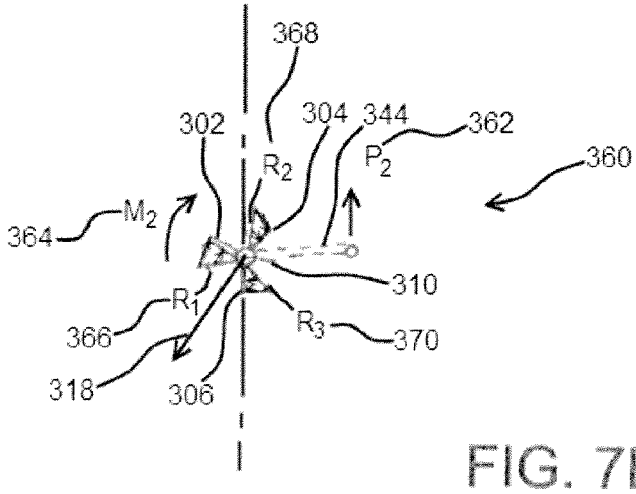
FIG. 7B is a plan view of an embodiment resisting a horizontal load from the item.

A discussion of the functional characteristics of the hanging apparatus 10 will now be provided as seen in FIGS. 7A and 7B. A single load item condition 340 is shown where the item 17 hanging from the hanger 16 is maintained a hanger arm distance 344 away from the center line of the vertical axis 310 of the upright 12. The item 17 exerts a vertical item load 342 on the upright 12. The vertical item load 342 may generally be the deadload of the garden item such as the plant with the soil and the container or basket. Additional vertical live loads may be included such as water which may accumulate within the container or birds and other animals which may perch on the container.

The ground in this particular situation is generally defined as the radial plane 318 where the anchor 14 is embedded within the ground. The embedded depth of the anchor is the first moment resisting arm 348. To maintain the upright 12 within its substantially vertical position, the anchor must resist a first moment 346 resulting from the vertical component of the load item 342 which is combined with the hanger arm distance or moment arm 344. The ground soil exerts a vertically aligned ground pressure 345 against the ground engaging surface area of the anchor 14. Depending on the particular anchor utilized as shown in the present concepts, the surface area may be the vertical surface area perpendicular to the vertically aligned ground pressure 345 which may include the spike portion 40, as well as portions of the radialy aligned fins or the multiple spike portions depending upon which embodiment is utilized.

Referring to FIG. 7B, a single load item condition with a horizontally aligned load component 360 is provided acting on the upright 12. In this particular embodiment, the anchor portion of the upright is utilizing three radialy aligned fins to act as ground engaging portions of the anchor for resisting a second moment resulting from the horizontal component of the load item 364. The first radialy aligned fin 302 applies the first horizontally aligned ground pressure 366 against the surface of the radialy aligned fin substantially perpendicular to the ground pressure. The second radially aligned fin 304 and the third radialy aligned fin 306 each act similarly to apply the second and third horizontally aligned ground pressures 368 & 370 respectively, to resist the second moment resulting from the horizontal component 362 of the load item 364.

This horizontal component results from either a combination of wind load, outside forces such as human interaction with the item 17, or a combination of a non-vertically aligned upright 12 creating a horizontal component from the dead load of the load item 17. In addition to the radialy aligned fins acting as moment resisting components, the plurality of spike portions 404, 406, and 408, as seen in FIG. 4A may also provide the necessary moment resisting capability.

Figure 8:
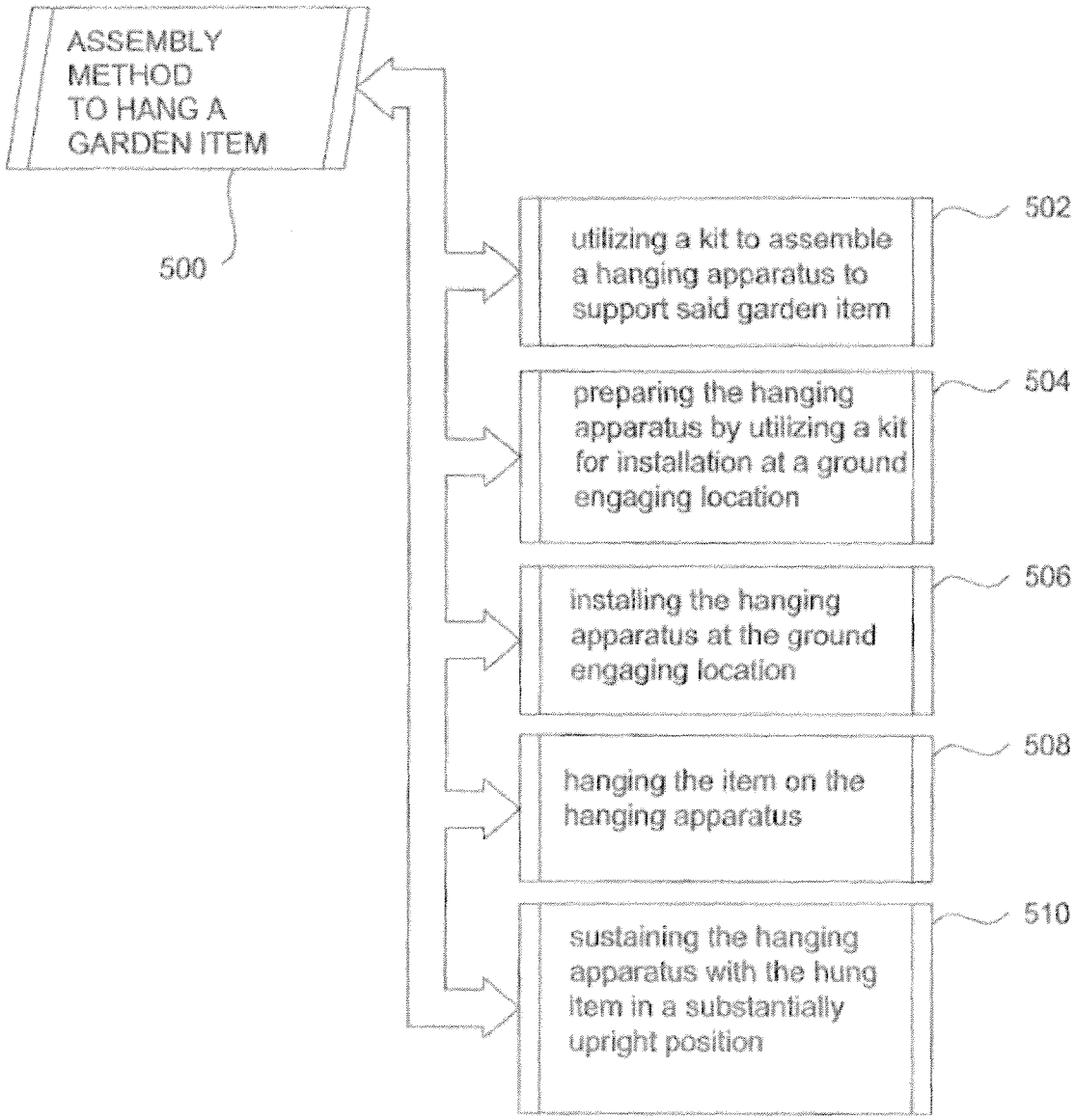
FIGS. 8-11 are flowchart diagrams of the assembly method to hang a garden item.

Lastly, a discussion assembly method for hanging garden item will now be provided. Referring to FIG. 8, an assembly method to hang a garden item 500 is provided. The method includes the following steps. At step 502, utilizing a kit to assemble a hanging apparatus to support a garden item. At step 504, preparing the hanging apparatus by utilizing a kit for installation at a ground engaging location. At step 506, installing the hanging apparatus at the ground engaging location. At step 508, hanging the item on the hanging apparatus. At step 510, sustaining the hanging apparatus with the hung item in a substantially upright position.

Figure 9:
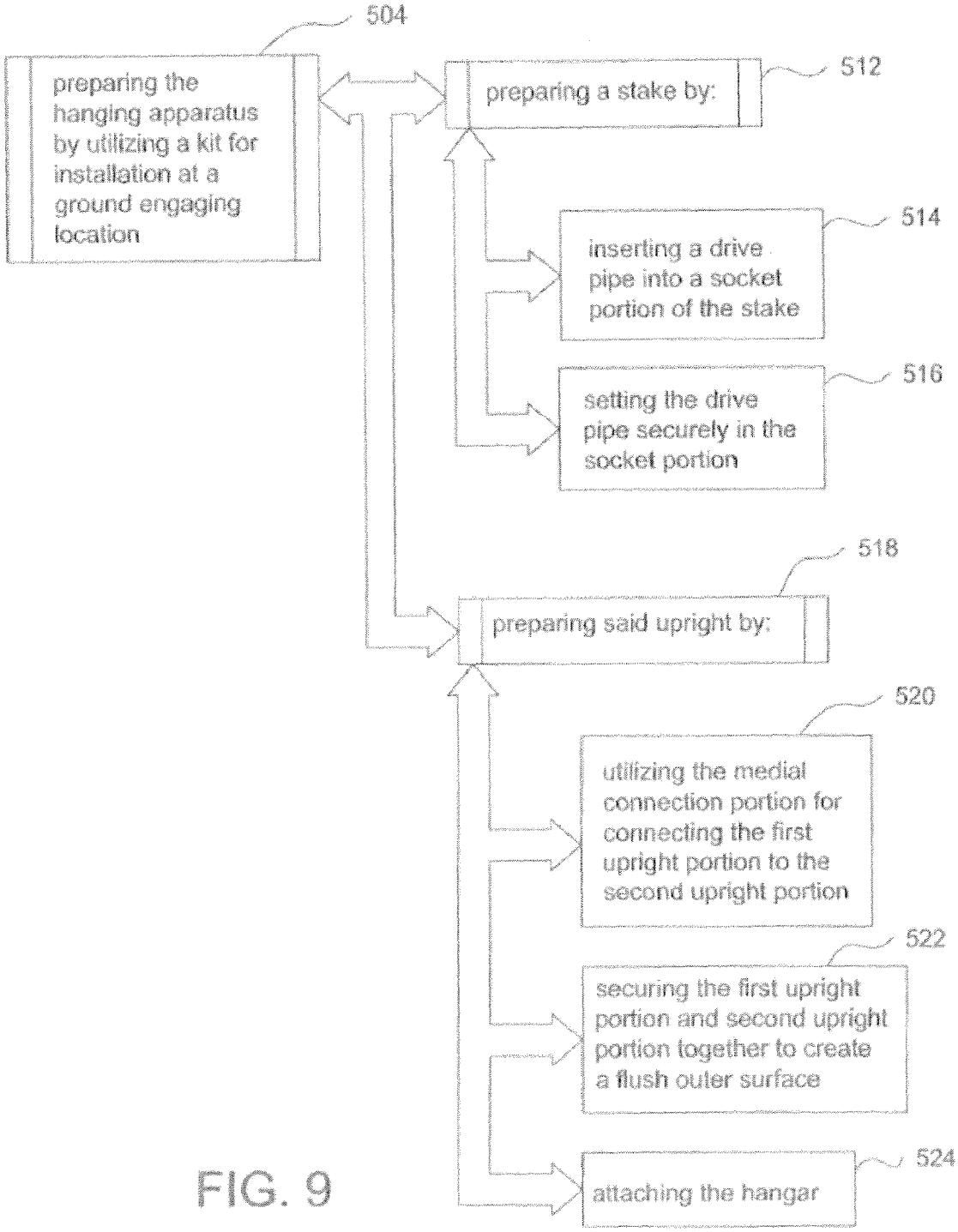

Referring to FIG. 9, a discussion of preparation of the hanging apparatus will now be provided. At step 504, the user will prepare the hanging apparatus by utilizing a kit for installation at a ground engaging location. The user will prepare a stake at step 512 by first inserting a drive pipe into the socket portion of the stake at step 514. Next, the user will set the drive pipe securely in the socket portion at step 516. The user will do this by utilizing the set screws and the self centering socket portion of the stake to secure the drive pipe in its proper position. The user can then prepare the upright at step 518. He will do this by utilizing the medial connection portion at step 520 by connecting the first upright portion to the second upright portion. The user will secure the first upright portion at step 522 to the second upright portion to create a flush outer surface. Once the upright is complete, the user can then attach the hanger at step 524.

Figure 10:
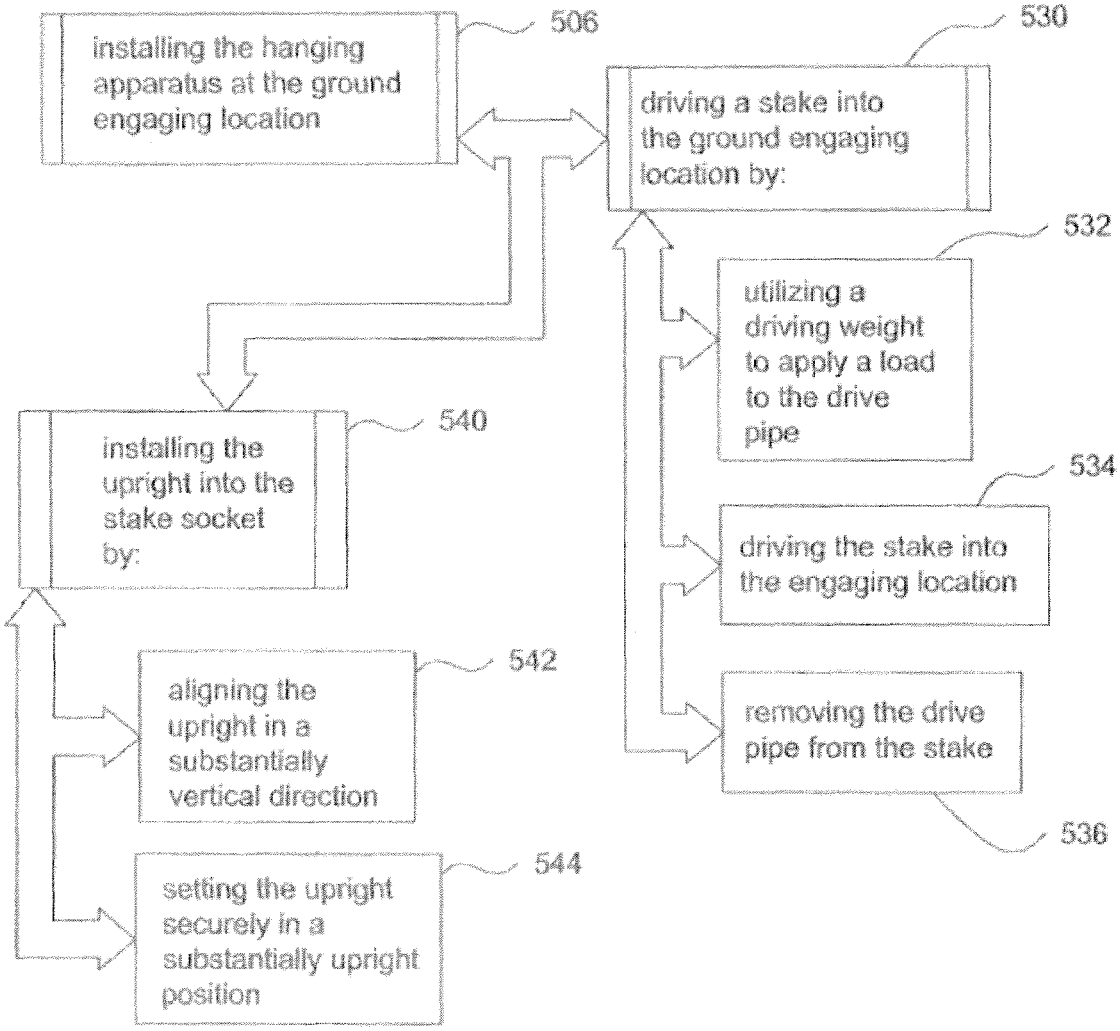

Referring to FIG. 10, a discussion of the installation of the hanging apparatus at the ground engaging location at step 506 will now be provided. The user will drive a stake into the ground engaging location at step 530. He will do this by utilizing a driving weight at step 532 which applies load to drive pipe secured within the socket of the stake. The user will drive the stake into the ground engaging location at step 534. Once the stake is secure within the ground engaging location, the user will remove the drive pipe from the stake at step 536. With the stake driven into the ground, the user can then install the upright into the stake socket at step 540. He can do this by aligning the upright in a substantially vertical direction within the socket at step 542 and then set the upright securely within the socket of the stake in a substantially upright position at step 544 by utilizing the set screws.

Figure 11:
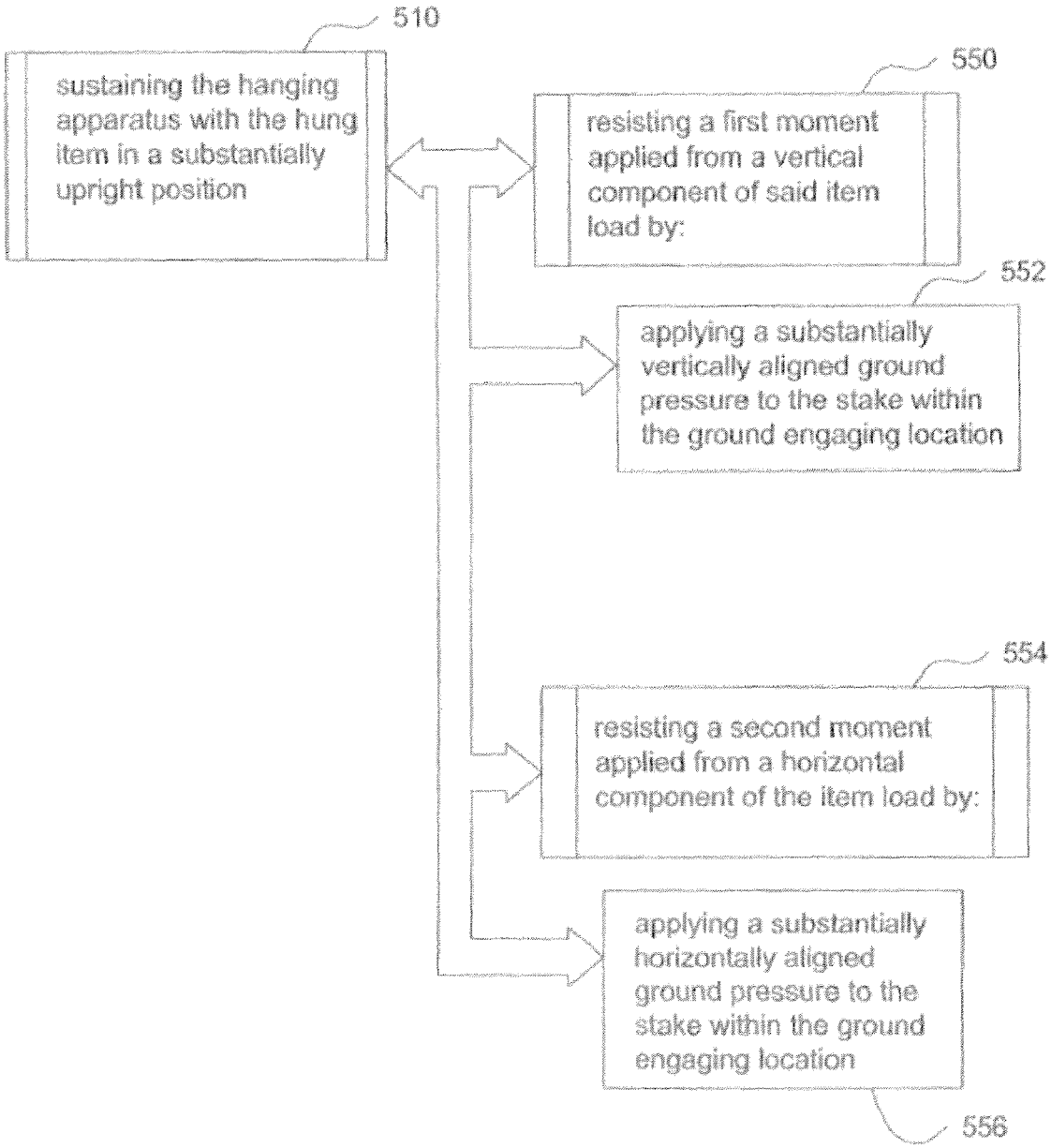

Referring to FIG. 11, the user can hang with the item load on the hanger of the hanging apparatus, which will sustain the hanging apparatus with the hung item in a substantially upright position at step 510. Here the hanging apparatus will resist a first moment applied from a vertical component of the item load at step 550. This is accomplished by applying a substantially vertically aligned ground pressure to the stake within the ground engaging location at step 552. Furthermore, a second moment is resisted from the horizontal component of an item load at step 554. This is accomplished by applying a substantially horizontally aligned ground pressure to the stake within the ground engaging location at step 556.

While there has been accomplished advantages by the Applicant's concepts, nevertheless, variation in the structure and the arrangement of the various parts are within the spirit and scope of the concepts as presented. The embodiments given have been given only by way of illustration and the Applicant is not to be limited to the embodiments shown and described.

I claim:

1. A garden item hanger assembly comprising:

a. an upright comprising a first upright portion and a second upright portion, said first upright portion comprising a first end configured to receive a medial connection portion; said second upright portion comprising a second end configured to receive said medial connection portion;

b. a ground engaging stake comprising a self-centering socket portion, a plurality of set screws radialy positioned about said self centering socket portion; a plurality of moment resisting surfaces; a first cylindrically configured spike comprising a point and a body portion;

c. said self-centering socket portion configured to optionally receive a drive pipe and said upright;

d. a semispherical stake cover portion to preserve said ground engaging stake when installed in a ground engaging location; said semispherical stake cover comprising an upright through port enabling said upright to extend out of said stake cover while preserving said stake;

e. a hanger comprising a first upright connection and a second item load support end, said hanger configured to cantilever from said upright to support said item load at a moment arm distance;

f. said ground engaging stake configured to resist an item load generated moment to maintain said upright in a substantially upright position.

2. The assembly according to claim 1 wherein said plurality of moment resisting surfaces further comprises: a plurality of radialy aligned ground engaging fins extending from said cylindrically configured spike.

3. The assembly according to claim 1 wherein said plurality of moment resisting surfaces further comprises: said first cylindrically configured spike, a second cylindrically configured spike and a third cylindrically configured spike extending from a spike plate connected to said self centering socket portion.

4. The hanger assembly according to claim 2 wherein said ground engaging stake further comprises: said upright maintained in a substantially upright position and configured to resist a first moment applied from a vertical component of said item load through application of a substantially vertical aligned ground pressure to said stake and said plurality of radially aligned ground engaging fins and said first cylindrically configured spike, whereby said first moment applied at said stake within said ground engaging location is resisted.

5. The hanger assembly according to claim 2 wherein said ground engaging stake further comprises: said upright maintained in a substantially upright position through resistance of a second moment applied from a horizontal component of said item load wherein a substantially horizontally aligned ground pressure is applied to said stake including said plurality of radially aligned ground engaging fins and said first cylindrically configured spike, to resist said second moment applied at said stake within said ground engaging location.

6. The hanger assembly according to claim 2 wherein said medial connection portion further comprises a nonstandard diameter threaded cylindrical stud.

7. The hanger assembly according to claim 6 wherein said upright further comprises: a nonstandard threaded inner diameter located at said first end of said first upright portion and configured to receive said nonstandard diameter threaded cylindrical stud.

8. The hanger assembly according to claim 7 wherein said upright further comprises: a nonstandard threaded inner diameter located at said second end of said second upright portion and configured to receive said nonstandard diameter threaded cylindrical stud.

9. The hanger assembly according to claim 2 wherein said assembly further comprises a shipping configuration, said shipping configuration comprising said first upright portion, said second upright portion, said drive pipe, said medial connection portion, said hanger all maintained within a shipping container for delivery to an end-user.

10. The hanger assembly according to claim 2 wherein said assembly further comprises: an assembled configuration comprising: said stake installed into a ground engaging location to maintain said upright in a substantially upright position through utilization of said set screws and said self centering socket to tighten said upright into a securely fitted upright position; said upright in a connected arrangement of said first upright portion securely fastened to said second upright portion through the use of said medial connection portion, and said hanger connected to said upright to maintain said load item a moment arm distance away from said upright.

11. An assembly method to hang a garden item, said method comprising the steps of:

a. utilizing a kit to assemble a hanging apparatus to support said garden item; said kit comprising a stake, a drive pipe, an upright comprising: a first upright portion, a second upright portion, a medial connection portion for connecting said first upright portion to said second upright portion, a first hanger, a semispherical stake cover comprising an upright through port enabling said upright to extend out of said stake cover while preserving said stake;

b. preparing said hanging apparatus by utilizing said kit for installation at a ground engaging location;

c. installing said hanging apparatus at said ground engaging location;

d. hanging said item on said hanging apparatus;

e. sustaining said hanging apparatus with said hung item in a substantially upright position.

12. The assembly method according to claim 11 wherein said preparing said hanging apparatus by utilizing said kit for installation at a ground engaging location further comprises:

a. preparing said stake by: inserting said drive pipe into a socket portion of said stake; setting said drive pipe securely in said socket portion by:

b. utilizing a plurality of radialy aligned socket set screws and tightening said plurality of radialy aligned socket set screws about said drive pipe;

c. preparing said upright by:

d. utilizing said medial connection portion for connecting said first upright portion to said second upright portion by:

e. securing said medial connection portion to a first end of said first upright portion;

f. securing said medial connection portion to a second end of said second upright portion;

g. securing said first upright portion and said second upright portion together to create a flush outer surface between said first upright portion and said second upright portion;

h. attaching the hanger.

13. The assembly method according to claim 12 wherein said installing said hanging apparatus at said ground engaging location further comprises:

a. driving said stake into said ground engaging location by:

b. utilizing a driving weight to apply a load to the drive pipe;

c. driving said stake into the ground until said stake is substantially submerged in said ground engaging location;

d. removing said drive pipe from said socket portion of said stake;

e. installing said upright into said stake socket by:

f. aligning the upright in a substantially vertical direction within said stake socket;

g. setting said upright securely within said stake socket by tightening said set screws against said upright.

14. The assembly method according to claim 13 wherein said sustaining said hanging apparatus with said item in a substantially upright position further comprises: resisting a first moment applied from a vertical component of said item load by:

a. applying a substantially vertically aligned ground pressure to said stake to resist said first moment applied at said stake within said ground engaging location;

b. resisting a second moment applied from a horizontal component of said item load by:

c. applying a substantially horizontally aligned ground pressure to said stake to resist said second moment applied at said stake within said ground engaging location.

15. The assembly method according to claim 14 wherein said item load further comprises: a dead load of the item comprising a container weight and a soil weight.

16. The assembly method according to claim 15 wherein said item load further comprises: a wind load component and a horizontal component of said dead load.

17. The assembly method according to claim 11 wherein said stake further comprises: a plurality of radialy protruding fins to provide additional ground engaging surface locations to resist a second moment about said stake.

18. The assembly method according to claim 11 wherein said medial connection portion further comprises: a non-standard diameter threaded cylindrical stud.

19. The assembly method according to claim 18 wherein said first upright portion further comprises: a non-standard threaded inner diameter located at said first end of said first upright portion configured to receive said nonstandard diameter threaded cylindrical stud.

20. The assembly method according to claim 19 wherein said second upright portion further comprises: said nonstandard threaded inner diameter located at said second end of said second upright portion configured to receive said nonstandard diameter threaded cylindrical stud.

21. The assembly method according to claim 20 wherein said method further comprises: securing said first upright portion and said second upright portion together by tightening together said first upright portion and said second upright portion with said nonstandard threaded cylindrical stud to create a flush outer surface between said first upright portion and said second upright portion.

* * * * *